US011692791B2

(12) United States Patent
Hogstad

(10) Patent No.: US 11,692,791 B2
(45) Date of Patent: Jul. 4, 2023

(54) CONCEALED HOLSTER FOR WOMEN

(71) Applicant: Pamela Jane Hogstad, Fargo, ND (US)

(72) Inventor: Pamela Jane Hogstad, Fargo, ND (US)

( * ) Notice: Subject to any disclaimer, the term of this patent is extended or adjusted under 35 U.S.C. 154(b) by 0 days.

(21) Appl. No.: 17/695,936

(22) Filed: Mar. 16, 2022

(65) Prior Publication Data

US 2022/0299295 A1 Sep. 22, 2022

Related U.S. Application Data

(60) Provisional application No. 63/163,526, filed on Mar. 19, 2021.

(51) Int. Cl.
*F41C 33/04* (2006.01)

(52) U.S. Cl.
CPC ..... *F41C 33/048* (2013.01); *F41C 33/041* (2013.01)

(58) Field of Classification Search
CPC .... F41C 33/048; F41C 33/02; F41C 33/0209; F41C 33/04; F41C 33/043; F41C 33/046
See application file for complete search history.

(56) References Cited

U.S. PATENT DOCUMENTS

| | | | | |
|---|---|---|---|---|
| 6,293,446 | B1 * | 9/2001 | Nielsen | F41C 33/046 224/675 |
| 6,398,089 | B1 * | 6/2002 | Har-Shen | F41C 33/0209 224/912 |
| 7,258,259 | B1 * | 8/2007 | Owens | F41C 33/041 224/912 |
| 10,415,927 | B1 * | 9/2019 | Shults | F41C 33/0209 |
| 11,419,367 | B1 * | 8/2022 | Hogstad | F41C 33/0209 |
| 2011/0233244 | A1 * | 9/2011 | Platts | F41C 33/046 224/243 |
| 2013/0082080 | A1 * | 4/2013 | Hellweg | F42B 39/02 224/672 |

* cited by examiner

*Primary Examiner* — Corey N Skurdal

(57) ABSTRACT

The present disclosure provides a concealed holster apparatus configured to be secured about the torso and to be anchored to an undergarment such as a bra. The holster comprises a molded plastic housing shaped to accommodate a belt strap which wraps around the torso, and which has a second strap affixed to an exterior surface allowing it to be wrapped around and under the strap or gore of an undergarment, securing it in place firmly. The housing is oriented such that the opening, and thus any firearm or other object held therein, is held horizontally, reducing the risk of it falling out or being difficult to remove.

10 Claims, 4 Drawing Sheets

CONCEALED HOLSTER FOR WOMEN

CROSS REFERENCES TO RELATED APPLICATIONS

The present application claims the benefit and priority of U.S. provisional application no. U.S. 63/163,526, filed Mar. 19, 1921.

FIELD OF INVENTION

The present invention relates generally to a concealed holster for women. More specifically, the present invention relates to a holster that anchors to an undergarment using a first strap and secures to the body using a second strap wrapped around the torso.

BACKGROUND

There are few on-body conceal carry holsters designed specifically for women. Despite the distinct structural differences in bodies of women and men, traditional holster types like those configured to be worn inside or outside the waistband, bellybands, and ankle holsters have only been adapted for women in their color offering, but this does nothing to improve the fit for a woman's body and so does not improve either comfort or concealment.

Some few attempts have been made to fill this gap in the market, such as for example bellybands, corset holster, thigh holsters, and bra holsters.

Both Bellybands and corset can ride up and down the body during wear since they are wide-fitting by design and have no anchor to a specific place on the torso, relying only on friction and tightness of fit to hold them in place. Both can also be uncomfortable in warmer weather. Thigh holsters cannot be worn by all women, and can slip or cause chafing on the leg.

Currently available bra holster designs either consist of complex contraptions with multiple straps that are difficult to put on and conceal, and which do not properly leverage the potential support a bra could provide, or use a single strap to couple the holster housing to the gore of the bra while the housing is tucked between the skin of the user and the bra itself. This latter design leads to multiple problems.

Since only a single strap is used to couple to the bra, the holster is only secured along a single axis, allowing for too much movement, which is both uncomfortable for the user and unsafe. Further discomfort is added by the fact the holster and any held firearm must be tucked under the bra, distorting the fit and potentially allowing the holster to fall out.

Importantly, such designs also only work with clamshell type holsters, where the opening of the holster into which a firearm is inserted is oriented downwards. Clamshell holsters have known issues of not always releasing the firearm, and of the firearm also simply falling out.

There is a need for a concealed holster design that properly leverages the bra as a supporting anchor without causing discomfort or risk to the user. It is within this context that the present invention is provided.

SUMMARY

The present disclosure provides a concealed holster apparatus configured to be secured about the torso and to be anchored to an undergarment such as a bra. The holster comprises a molded plastic housing shaped to accommodate a belt strap which wraps around the torso, and which has a second strap affixed to an exterior surface allowing it to be wrapped around and under the strap or gore of an undergarment, securing it in place firmly. The housing is oriented such that the opening, and thus any firearm or other object held therein, is held horizontally, reducing the risk of it falling out or being difficult to remove.

Thus, according to one aspect of the present disclosure there is provided a concealed holster apparatus suitable for being coupled to an undergarment, comprising: a plastic housing having a first wall and an opposing second wall which together form an open-ended hollow receiving area for holding an object, the receiving area being oriented along a first axis, wherein the first wall of the housing is configured to receive a belt strap in an indented strip running parallel to the first axis, and has a first opening formed therein for receiving a fastening element.

The holster apparatus further comprises a belt strap dimensioned to thread through the indented strip of the housing and wrap about the torso of a user, the belt strap being formed of an elastic material with a central portion reinforced by a non-elastic material; and a securing strap having a coupling mechanism on each end of its length and having a second opening formed therein for receiving the fastening element, the securing strap being configured thereby to be secured to an exterior surface of the first wall of the housing by a fastening element, to wrap around a portion of an undergarment in a direction orthogonal to the first axis, and to thereby secure the holster to the undergarment.

In some embodiments, the plastic of the housing is a thermoplastic such as Kydex, Holstec, or Bolatron.

In some embodiments, the housing is formed of a single molded piece of plastic.

In some embodiments, the housing is shaped to receive a firearm.

In some embodiments, the belt strap comprises coupling mechanisms at either end of its length for an adjustable fit about the torso of a wearer. The coupling mechanisms of the belt strap may comprise one of a snap fitting, a hook and loop coupling such as Velcro, a button assembly, a magnet assembly, or a buckle assembly.

In some embodiments, the non-elastic material of the belt strap is one of: webbing, leather, or suede.

In some embodiments, the material of the securing strap is one of: webbing, leather, or suede.

In some embodiments, coupling mechanism of the securing strap comprises one of a snap fitting, a hook and loop coupling such as Velcro, a button assembly, a magnet assembly, or a buckle assembly.

In some embodiments, the apparatus further comprises a fastening element for affixing the securing strap to the exterior surface of the first wall of the housing.

BRIEF DESCRIPTION OF THE DRAWINGS

Various embodiments of the invention are disclosed in the following detailed description and accompanying drawings.

Figure 1:
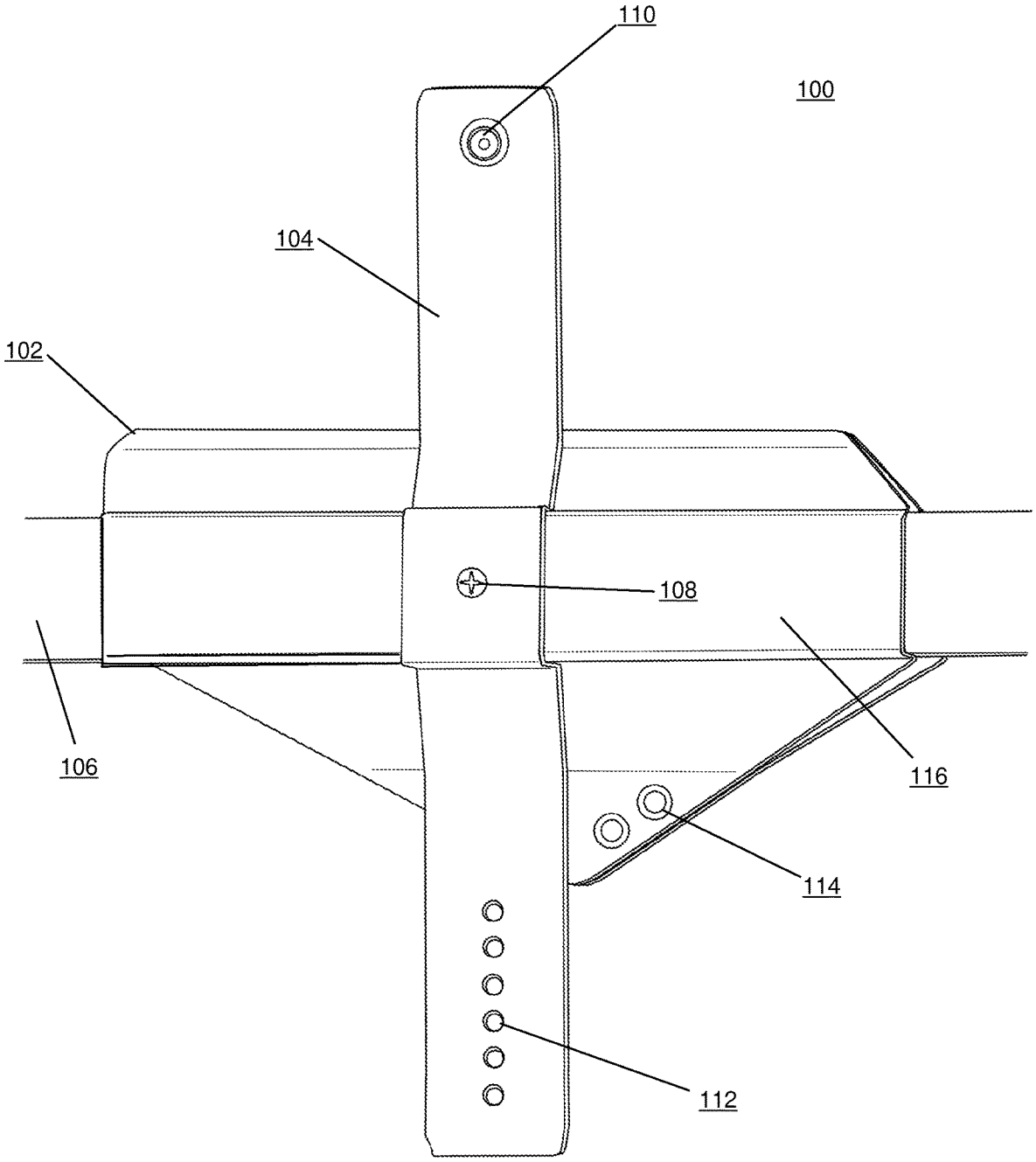
FIG. 1 illustrates an isometric rear view of an example configuration of the concealed holster apparatus of the present disclosure.

Common reference numerals are used throughout the figures and the detailed description to indicate like elements. One skilled in the art will readily recognize that the above figures are examples and that other architectures, modes of operation, orders of operation, and elements/functions can be provided and implemented without departing from the characteristics and features of the invention, as set forth in the claims.

DETAILED DESCRIPTION AND PREFERRED EMBODIMENT

The following is a detailed description of exemplary embodiments to illustrate the principles of the invention. The embodiments are provided to illustrate aspects of the invention, but the invention is not limited to any embodiment. The scope of the invention encompasses numerous alternatives, modifications and equivalent; it is limited only by the claims.

Numerous specific details are set forth in the following description in order to provide a thorough understanding of the invention. However, the invention may be practiced according to the claims without some or all of these specific details. For the purpose of clarity, technical material that is known in the technical fields related to the invention has not been described in detail so that the invention is not unnecessarily obscured.

The terminology used herein is for the purpose of describing particular embodiments only and is not intended to be limiting of the invention. As used herein, the term "and/or" includes any combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

As stated above, there are few concealed carry holsters designed specifically for women that are actually safe, inconspicuous, comfortable and accessible. The present disclosure provides a new concealed holster apparatus which overcomes the issues associated with prior art holsters, taking advantage of the support structure provided by a piece of clothing women wear every day.—the bra.

The foundation of the bra that already has straps over the shoulder and a band and central gore around the torso is a great foundation to firmly hold a holster to the body. The holster of the present disclosure is specifically designed to couple and be anchored to a bra in the centre chest area of a woman, often called the "sweet spot" in the industry because it is one of the best places to carry for women who want the safety of a holster while keeping it comfortable, concealed and accessible. The holster could also be coupled to other undergarments though.

Figure 2:
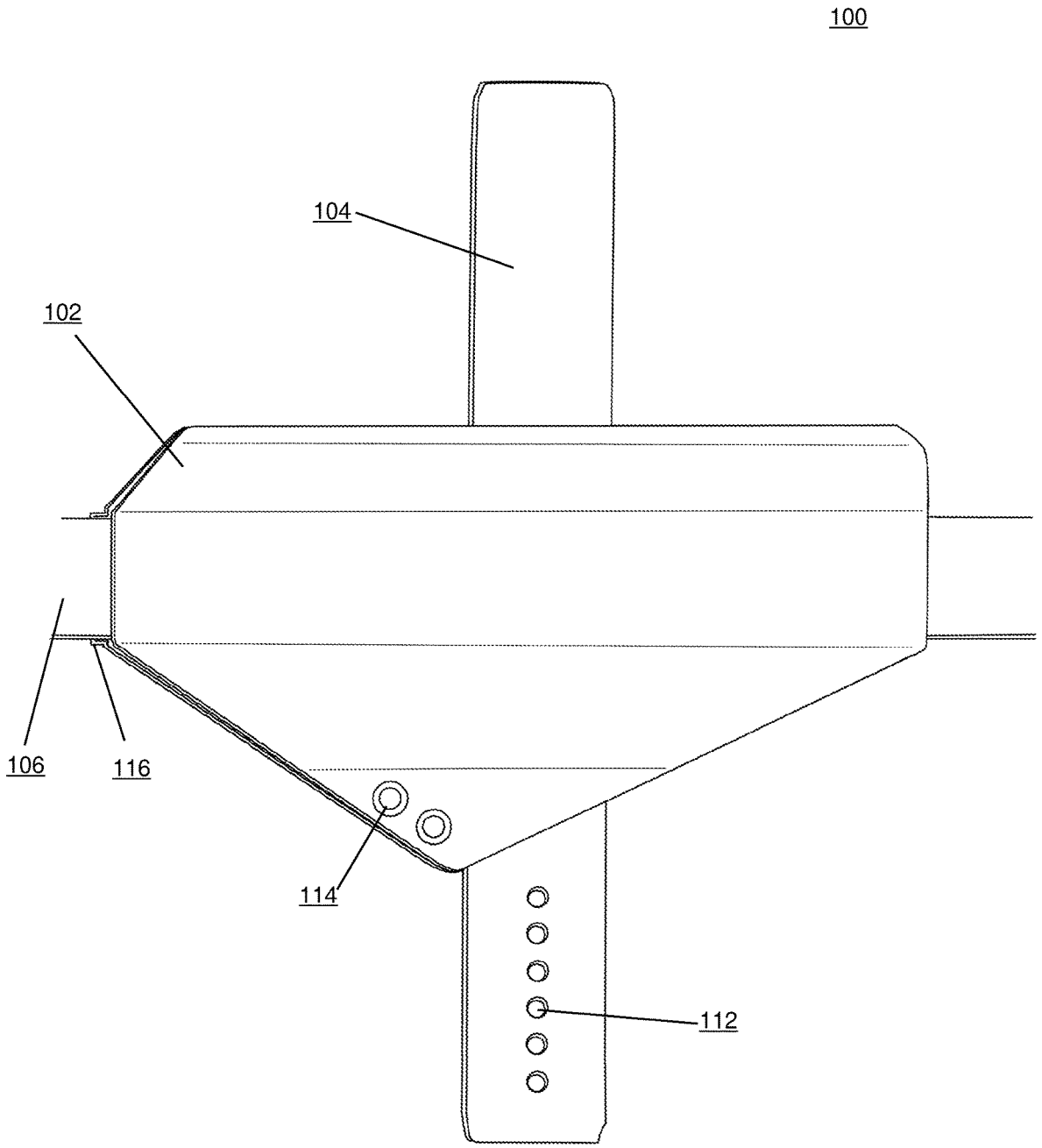
FIG. 2 illustrates an isometric frontal view of the example configuration of the concealed holster apparatus of the present disclosure.

Referring to FIGS. 1 and 2 an isometric rear (FIG. 1) and frontal (FIG. 2) views are shown of an example configuration of the concealed holster apparatus 100.

The example holster 100 has a full thermoplastic molded housing 102 that is shaped to cover a firearm and to encompass the trigger of the firearm while it is held there, ensuring the wearer's safety against unintentional trigger pulls. It should be noted that the housing 102 could also be shaped to hold and receive other items such as pepper spray, tasers, knives, or even mobile phones etc. The only change in the manufacturing process would be to use a different shape of mould for the housing 102.

Thermoplastics are ideal for manufacturing items such as holsters because a single molded piece can form the entire housing. Suitable thermoplastics include but are not limited to Kydex, Holstec, and Bolatron.

The holster 100 is designed to fit over the gore of the bra, with the opening for the firearm oriented horizontally, and with a securing strap 104 affixed to an outer surface of the housing walls 102.

The strap has an adjustable coupling mechanism, in this case a snap fitting 110 consisting of a cap and a socket configured to wrap around the and under the central gore of a bra, affixing to itself and anchoring the holster to the bra. This avoids the uncomfortable distortion of the bra caused by prior art designs, since the securing strap 104 is made of thin material, and only that needs to be placed between the bra and the skin of the user, rather than the entire housing.

A set of holes 112 are provided on the opposing end of the strap 104 so that the holster apparatus can be adjusted to accommodate different gore sizes, the user simply unscrews fastening element 108, threads it through the appropriate hole 112 for the gore size, and reassembles the holster.

Other types of coupling mechanism can be used such as buttons, magnets, buckles, Velcro, etc. Depending on the type chosen, the strap 104 would be prepared so that it would be adjustable to accommodate various gore sizes.

Both the wall of the housing 102 to which the strap 104 is affixed and the strap 104 itself have holes punched in them through which a fastening element 108 is threaded, pinning the strap 104 to the outer surface of the housing 102. In the present example the fastening element 108 is a post configured to receive a screw which holds the snap stud in place to receive the cap/socket for securing 104 to the holster. The fastening element 108 may also, for example, be a screw, rivet, or other similar mechanism.

In the present example, the strap 104 is affixed to the rear wall of the housing, which is preferable for providing a flatter outer profile and avoiding the outline of the strap being visible under the wearer's clothes. In other examples however the strap 104 could be affixed to the front wall.

Figure 3:
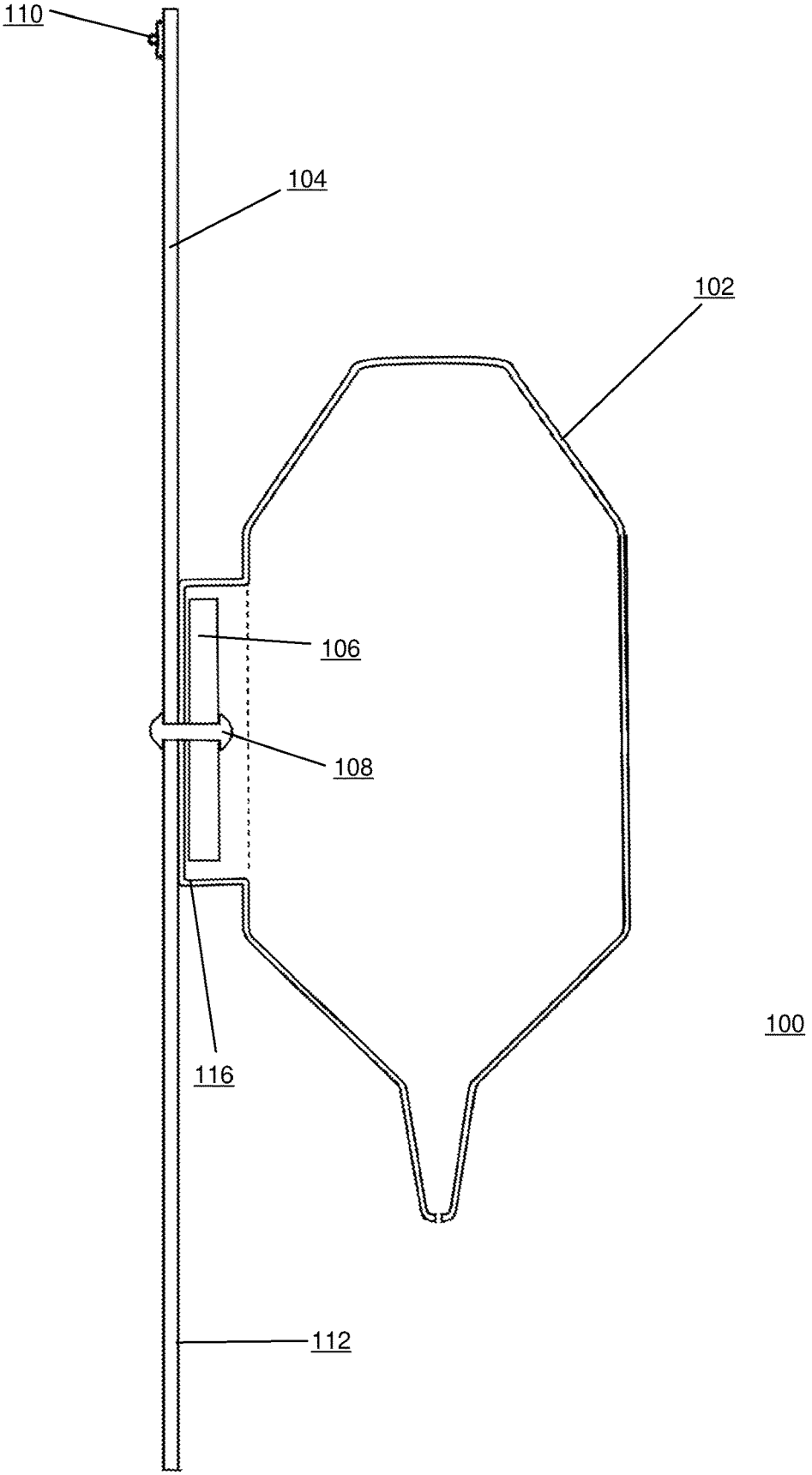
FIG. 3 illustrates a cutaway profile view of the example configuration of the concealed holster apparatus of the present disclosure.

If only the securing strap 104 was used to secure the holster 100 in place, it might be prone to rocking side to side, another problem associated with prior art designs. In order to avoid this, the housing 102 is shaped to accommodate a belt strap 106, which runs through the inside of the housing in an indented portion 116 specifically shaped to accommodate the belt strap 106 (see the side profile cutaway view shown in FIG. 3). The fastening element 108 also runs through the belt strap 106, affixing it in place against the indented portion 116 of the housing.

In other examples, one or more belt loops may be used to keep the belt strap 106 in place in the indented portion 116.

If the housing 102 is formed of a single piece of plastic then holes 114 for securing the two ends together may be provided, allowing the ends of the piece to be secured together by rivets, posts, or screws.

Though not illustrated, the housing may have one or more belt loops formed on it or affixed to it for holding the belt 106 in place.

Figure 4:
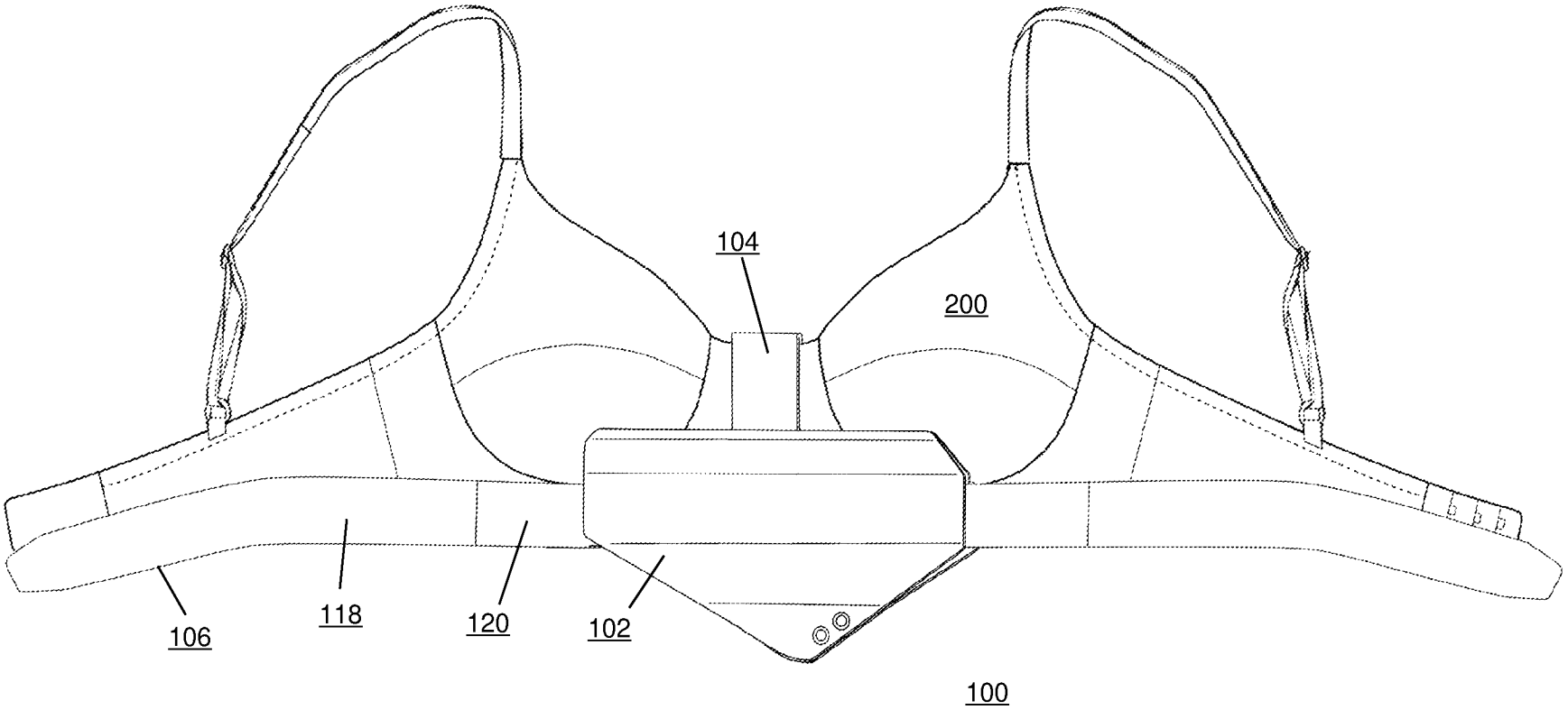
FIG. 4 illustrates an isometric view of the example configuration of the concealed holster apparatus coupled to an undergarment.

Referring to FIG. 4, an isometric view of the example configuration of the concealed holster apparatus 100 is shown coupled to a the gore of a bra 200 as intended.

As can be seen, the holster 100 sits over the gore of the bra 200, avoiding distortion of the fit on a wearer, and is oriented the same as a traditional holster would be, with the opening for the firearm pointing sideways and not downwards. The grip thus falls away from the body while wearing whether sitting or bending over, walking, shopping etc, facilitating a fast draw of the firearm.

The belt strap 106 ends run parallel to and can be aligned over and faded into the straps of the bra 200, reducing the amount of surface area the holster covers and making it easier to conceal. Furthermore, since the holster 100 is anchored to the bra, there is no risk of the belt riding up or down on the body. The slim belt strap 106 is also less prone to overheating the user than holsters having large assemblies of straps and alternate types of holster such as bellybands and corset holsters.

The belt 106 that runs inside the length of the thermoplastic housing 102 could be formed of any suitable elastic material or webbing. In the present example, the belt 106 has an elastic portion 118 on either side with a central portion 120 that is reinforced with a firmer material such as for example leather, suede or other materials. This prevents stretching and thus fraying and friction of the belt strap 106 against the housing 102. In the present example, the portion 120 has plastic coated webbing sewn over it to keep the belt in the channel.

Either end of the belt strap 106 are provided with coupling mechanisms such as that buckles, snaps, magnets, or velcro etc. allowing it to wrap around the torso over the bra band becoming part of the bra for additional concealment.

If using belt loop(s) on the outside of the holster to accommodate a belt can be used without additional sewing or use of a punch hole. One would place the adjustable belt inside the holster and using hardware to attach the belt by pushing the hardware through the hole of the belt and holster to the outside of the holster. The hardware now coming through from the inside of the holster to the outside would go through a hole on the strap and closing component and a screw or other hardware would be placed down through the post holding the strap with a closing component and belt firmly to the holster. Additionally, a retention device such as a Safariland product or a simple strap could be added for the purpose of further retention of the gun in the holster. Spacing for this would be done during the molding process if necessary.

How to Make the Invention:

A plastic housing is made using a firearm or mold for specific firearms. Preparation of the firearm/mold would allow for a belt to lay flatly behind the firearm inside the length of the holster or another version of allowing for belting on the outside of the holster but worn in the same way.

The holster would be fitted with screws or rivets for firearm retention and the adjustable belt and strap would be screwed or attached to the holster by various mechanisms. The belt would run inside the holster, the gore strap and closing component would be on the outside of the holster. Both the belt and the strap with a closing component would be attached to the holster using one screw, rivet or other hardware thru one hole. There could be variations of attaching the belt, gore strap, etc for this holster for future improvements. Belt loops on the outside of the holster would also be attached to the holster with screws and other hardware.

An alternative could be an attached belt loop or loops screwed to the outside on the back of the kydex for the placement of the belt. Allowance for hardware to attach would be anticipated. The strap to attach around the bra gore is screwed to the holster either along with the belt or separately if used with an added belt loop or loops.

Components can be changed where they are placed for a better fit, or for instance where or how the belt or strap is attached to the holster. The strap or belt might be thinner or wider. Improvements of all components and how and where they are use is welcome for improving the function of the holster.

How to Use the Invention:

A person would place the outside strap 104 of the holster 100 around the gore of the bra on the outside of the bra and for the best fit would adjust the length of the strap with the coupling mechanism to the width needed to best fit the gore of the bra.

A person would then wrap the adjustable belt 106 around the torso over the band of the bra adjusting the belt for the most comfortable and secure fit. The holster is now firm and stable on the body located in one of the best areas that women can carry for concealment and comfort.

The firearm can then be placed in the holster for accessibility. A retention strap may be placed around the grip of the gun for additional retention of the firearm. Other retention options may be used such as additional straps, thermoplastic trigger retentions, etc.

Unless otherwise defined, all terms (including technical terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

The disclosed embodiments are illustrative, not restrictive. While specific configurations of the concealed holster apparatus have been described in a specific manner referring to the illustrated embodiments, it is understood that the present invention can be applied to a wide variety of solutions which fit within the scope and spirit of the claims. There are many alternative ways of implementing the invention.

It is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A concealed holster apparatus suitable for being coupled to an undergarment, comprising:

a plastic housing having a first wall and an opposing second wall which together form an open-ended hollow receiving area for holding an object, the receiving area being oriented along a first axis, wherein the first wall of the housing is configured to receive a belt strap in an indented strip running parallel to the first axis, and has a first opening formed therein for receiving a fastening element;

a belt strap dimensioned to thread through the indented strip of the housing and wrap about the torso of a user, the belt strap being formed of an elastic material with a central portion reinforced by a non-elastic material;

a securing strap having a coupling mechanism on each end of its length and having a second opening formed therein for receiving the fastening element, the securing strap being configured thereby to be secured to an exterior surface of the first wall of the housing by the fastening element, to wrap around a portion of the undergarment in a direction orthogonal to the first axis, and to thereby secure the holster to the undergarment.

2. A concealed holster apparatus according to claim 1, wherein the plastic of the housing is a thermoplastic.

3. A concealed holster apparatus according to claim 1, wherein the housing is formed of a single molded piece of plastic.

4. A concealed holster apparatus according to claim 1, wherein the housing is shaped to receive a firearm.

5. A concealed holster apparatus according to claim 1, wherein the belt strap comprises coupling mechanisms at either end of its length for an adjustable fit about the torso of a wearer.

6. A concealed holster apparatus according to claim 5, wherein coupling mechanisms of the belt strap comprise one of a snap fitting, a hook and loop coupling such as Velcro, a button assembly, a magnet assembly, or a buckle assembly.

7. A concealed holster apparatus according to claim 1, wherein the non-elastic material of the belt strap is one of: webbing, leather, suede, or plastic-covered webbing.

8. A concealed holster apparatus according to claim 1, wherein the material of the securing strap is one of: webbing, leather, or suede.

9. A concealed holster apparatus according to claim 1, wherein the coupling mechanism of the securing strap comprises one of a snap fitting, a hook and loop coupling such as Velcro, a button assembly, a magnet assembly, or a buckle assembly.

10. A concealed holster apparatus according to claim 1, wherein the apparatus further comprises a fastening element for affixing the securing strap to the exterior surface of the first wall of the housing.

* * * * *